US007134876B2

(12) United States Patent
Hou

(10) Patent No.: US 7,134,876 B2
(45) Date of Patent: Nov. 14, 2006

(54) SOUND SYSTEM WITH DEDICATED VOCAL CHANNEL

(75) Inventor: Jason S. C. Hou, Covina, CA (US)

(73) Assignee: Mica Electronic Corporation, LaVerne, CA (US)

( * ) Notice: Subject to any disclaimer, the term of this patent is extended or adjusted under 35 U.S.C. 154(b) by 228 days.

(21) Appl. No.: 10/812,721

(22) Filed: Mar. 30, 2004

(65) Prior Publication Data

US 2005/0239030 A1 Oct. 27, 2005

(51) Int. Cl.
*G10H 1/36* (2006.01)

(52) U.S. Cl. ..... 434/307 A; 434/307 R; 84/610

(58) Field of Classification Search ..... 434/156, 434/307 R–309, 318, 365; 84/601, 609, 84/610, 626; 369/30.18, 47.34; 345/23; 386/125; 704/258; 709/219
See application file for complete search history.

(56) References Cited

U.S. PATENT DOCUMENTS 5,235,124 A * 8/1993 Okamura et al. ..... 434/307 A
5,286,907 A * 2/1994 Okamura et al. ..... 434/307 A
5,484,291 A * 1/1996 Nakai et al. ..... 434/307 A
5,518,408 A * 5/1996 Kawashima et al. .... 434/307 A
5,569,038 A * 10/1996 Tubman et al. ..... 434/308
5,611,693 A * 3/1997 Chaya et al. ..... 434/307 A
5,619,425 A * 4/1997 Funahashi et al. ..... 709/219
5,654,516 A * 8/1997 Tashiro et al. ..... 84/601
5,689,081 A 11/1997 Tsurumi
5,734,636 A * 3/1998 Lee et al. ..... 369/47.34
5,742,569 A * 4/1998 Yamamoto et al. ..... 369/30.18
5,750,912 A * 5/1998 Matsumoto ..... 84/609
5,796,913 A * 8/1998 Takada et al. ..... 386/125
5,804,752 A 9/1998 Sone et al.
5,811,708 A 9/1998 Matsumoto
5,827,990 A * 10/1998 Fujita ..... 84/610
5,854,619 A * 12/1998 Kato ..... 345/23
5,899,699 A 5/1999 Kamiya
5,900,566 A 5/1999 Mino et al.
6,066,792 A * 5/2000 Sone ..... 84/609
6,259,015 B1 * 7/2001 Takahashi et al. ..... 84/626
6,836,761 B1 * 12/2004 Kawashima et al. ..... 704/258
2001/0008753 A1 * 7/2001 Wakamoto ..... 434/156
2001/0044721 A1 * 11/2001 Yoshioka et al. ..... 704/258

* cited by examiner

*Primary Examiner*—Joe H. Cheng
(74) *Attorney, Agent, or Firm*—Kenneth L. Sherman, Esq.; Vic Y. Lin, Esq.; Myers Dawes Andras & Sherman, LLP

(57) ABSTRACT

A karaoke sound system had a mixer that combines the singer's real-time voice signal from a microphone with the pre-recorded background song/music signal from a player, an amplifier that receives the mixed signal from the mixer to provide amplification or gain boosting, a dedicated channel for the vocal signal from the microphone without using a mixing device, one or more speakers to output the mixed and amplified audio signal, and one or more speakers to output the vocal signal from the dedicated channel. The vocal channel allows the vocals to maintain an overall cleaner and vibrant sound, with a "live feeling" positional presence.

28 Claims, 8 Drawing Sheets

200

SOUND SYSTEM WITH DEDICATED VOCAL CHANNEL

FIELD OF THE INVENTION

The present invention relates in general to karaoke, public address and audio systems and in particular to a karaoke system with a dedicated vocal channel.

BACKGROUND OF THE INVENTION

A conventional karaoke system plays a requested pre-recorded song that is mixed with a vocal performance of a singer. Typically, lyrics of the requested song are displayed on a monitor to aid the singer to sing along. A set of instrumental songs are played through the Karaoke system for the singer to sing along with.

Such a conventional karaoke system comprises: (1) a mixer that combines the singer's real-time voice signal from a microphone with the pre-recorded background song/music signal from a player, (2) an amplifier that receives the mixed signal from the mixer to provide amplification or gain boosting, and (3) one or more speakers to output the mixed and amplified audio signal. For stereo output two speakers are used and for mono output one speaker is used.

However, though this configuration works for many standard audio applications, because the vocal and music signals are pre-mixed into one signal for speaker output, the vocals tend to lack definition. Further, the vocals have to compete with the music for sound space, thereby often sounding muddy, far away and without direction.

There is, therefore, a need for a sound system that provides an additional channel dedicated to microphone output along with the conventional output of pre-mixed music and microphone output. There is also a need for such a system to allow the microphone output to be heard clearly with directional presence, without having to compete with the pre-mixed music for sound space.

BRIEF SUMMARY OF THE INVENTION

The present invention addresses the above needs. In one embodiment the present invention provides a sound system comprising: a mixer that combines the singer's real-time voice signal from a microphone with the pre-recorded background song/music signal from a player, an amplifier that receives the mixed signal from the mixer to provide amplification or gain boosting, a dedicated channel for the vocal signal from the microphone without using a mixing device, a dedicated amplifier that receives the vocal signal to provide amplification or gain boosting, and one or more speakers to output the vocal signal from the dedicated channel. The vocal channel allows the vocals to maintain an overall cleaner and vibrant sound, with a "live feeling" positional presence without the need for multiple mixers, amplifier and/or speaker combinations.

In another embodiment, the present invention provides a sound system comprising: a mixer that combines the singer's real-time voice signal from a microphone with the pre-recorded background song/music signal from a player, an amplifier that receives the mixed signal from the mixer to provide amplification or gain boosting, one or more speakers to output the mixed and amplified audio signal, a dedicated channel for the vocal signal from the microphone without using a mixing device, and an optional synchronizer circuit that allows synchronization or feedback control between the amplifier and the dedicated voice channel.

Such embodiments of sound systems according to the present invention improves the overall sound quality and vocal presence in karaoke sound systems including karaoke boom boxes, karaoke mixers, karaoke mixing amplifiers, karaoke players, etc.

These and other features, aspects and advantages of the present invention will become understood with reference to the accompanying drawings, and the following description, appended claims.

DETAILED DESCRIPTION OF THE INVENTION

Figure 1:
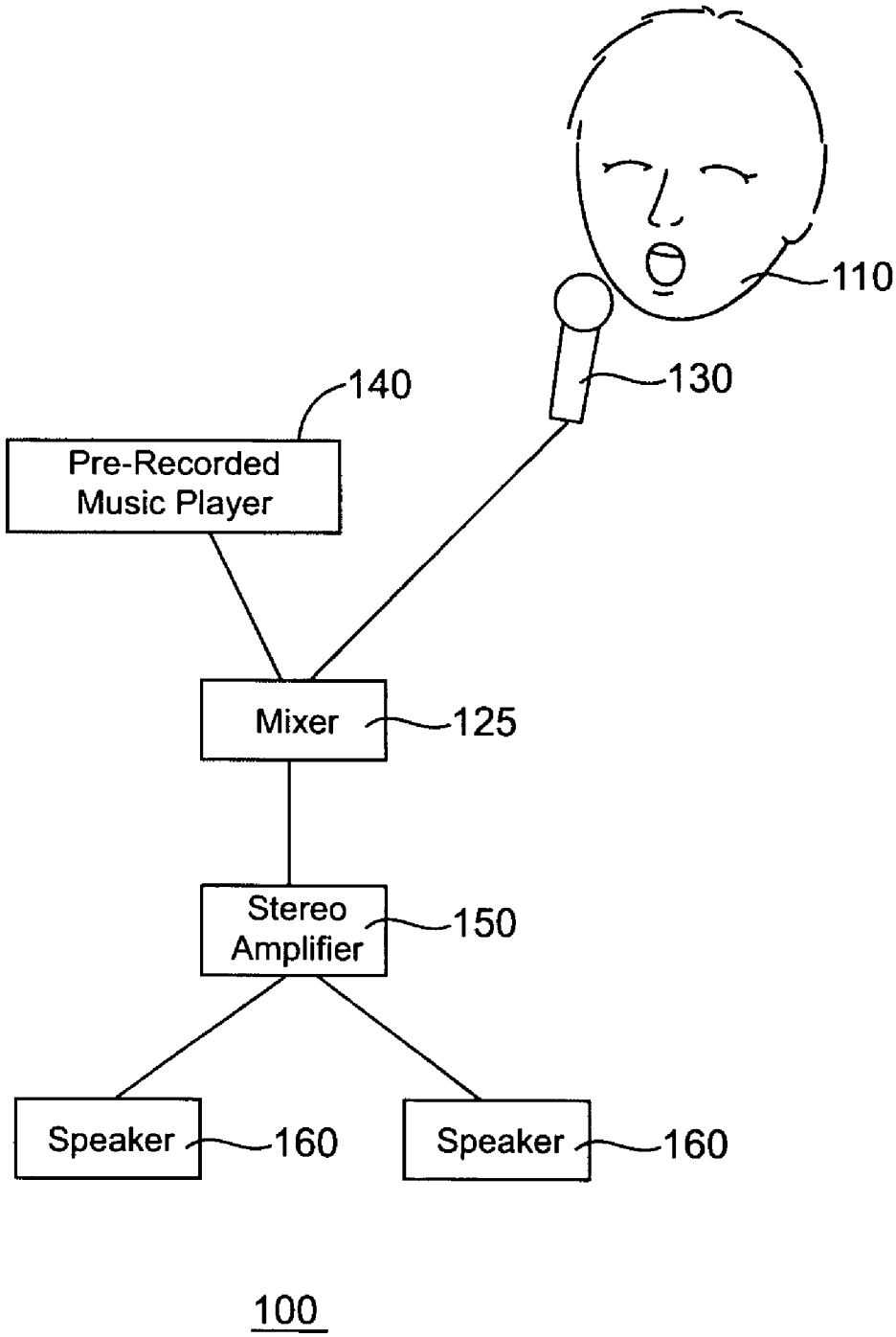
FIG. 1 (Prior Art)
FIG. 1 shows a block diagram of a conventional karaoke system wherein music and vocals are pre-mixed into one signal for speaker output.

FIG. 1 shows a block diagram of a conventional karaoke sound system 100 wherein music and vocals by a user 110 are pre-mixed into one signal for speaker output. As noted above, such a convention karaoke sound system 100 comprises: a mixer 125 that combines the singer's real-time voice signal from a microphone 130 with the pre-recorded background song/music signal from a player 140 (e.g., CD player); an amplifier 150 that receives the mixed signal from the mixer 125 to provide amplification or gain boosting; and one or more speakers 160 to output the mixed and amplified audio signal. As shown, for stereo output two speakers 160 are used and for mono output one speaker 160 can be used.

In this configuration, because the vocal and music signals are pre-mixed into one signal for speaker output, the vocals tend to lack definition. Further, the vocals have to compete with the music for sound space, thereby sounding muddy, far away and without direction.

Figure 2A:
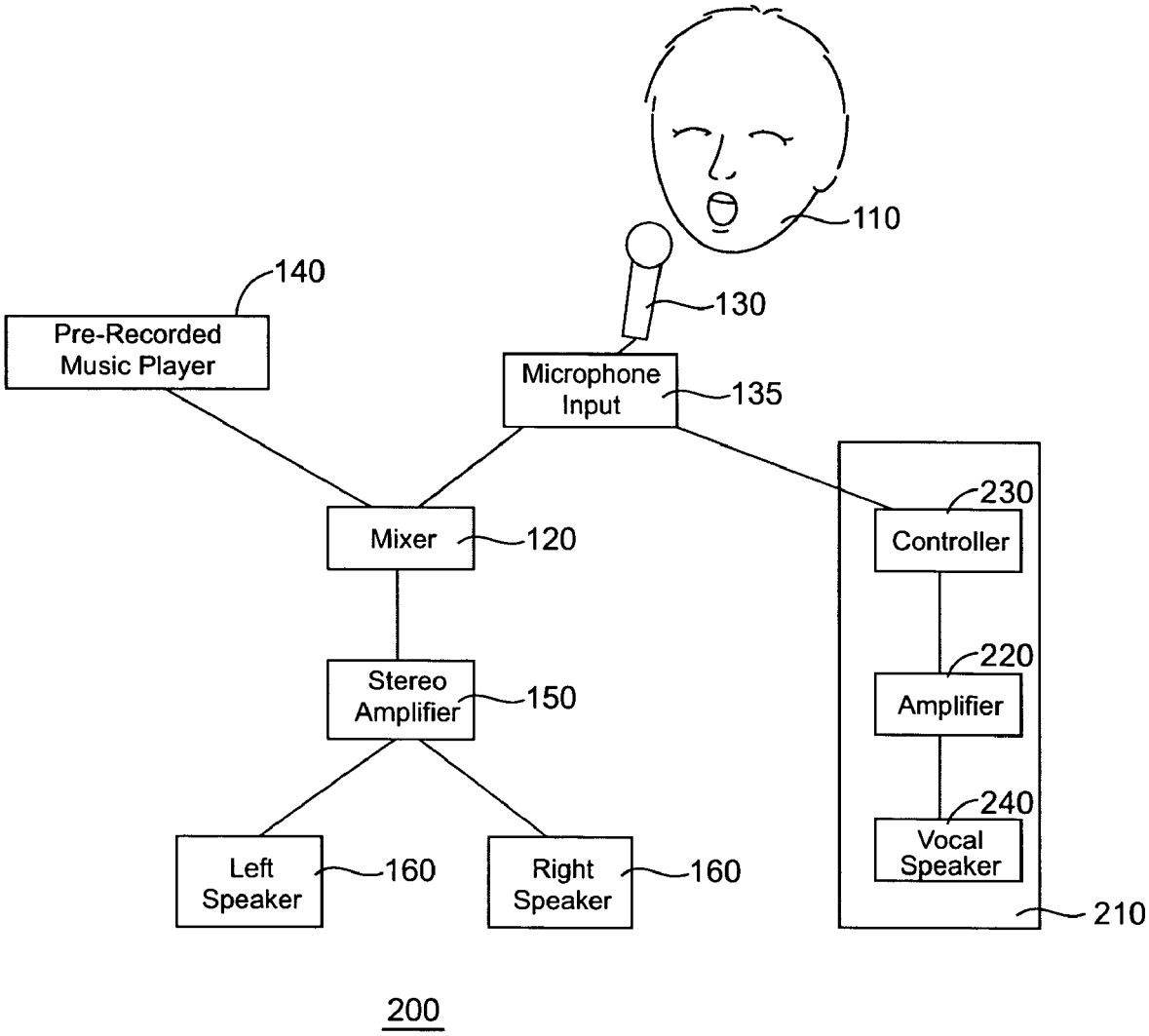
FIG. 2A shows an example functional block diagram of an embodiment of a sound system having a dedicated vocal channel according to the present invention.

FIG. 2A shows an example functional block diagram of an embodiment of a sound system 200 according to the present invention which addresses the above problems. The sound system 200 comprises: (1) a mixer 120 that combines the singer's real-time voice signal from a microphone 130 via an input device 135, with the pre-recorded background song/music signal from a player 140, (2) an amplifier 150 that receives the mixed signal from the mixer 120 to provide amplification or gain boosting, (3) one or more speakers 160 to output the mixed and amplified audio signal, and (4) a dedicated channel 210 for the vocal signal from the microphone 130 without using a mixing device.

In this embodiment, the dedicated vocal channel 210 comprises an amplifier 220, a controller 230 (e.g. volume control, gain control, bass control, treble control, surround sound control, etc.) and one or more speakers 240 to output the amplified and controller vocal signal. In another example, the controller 230 can be a component of the amplifier 220. The dedicated vocal channel 210 allows the vocals to maintain an overall cleaner and vibrant sound, with a "live feeling" positional presence without the need for multiple mixer, amplifier and/or speaker combinations.

Figure 2B:
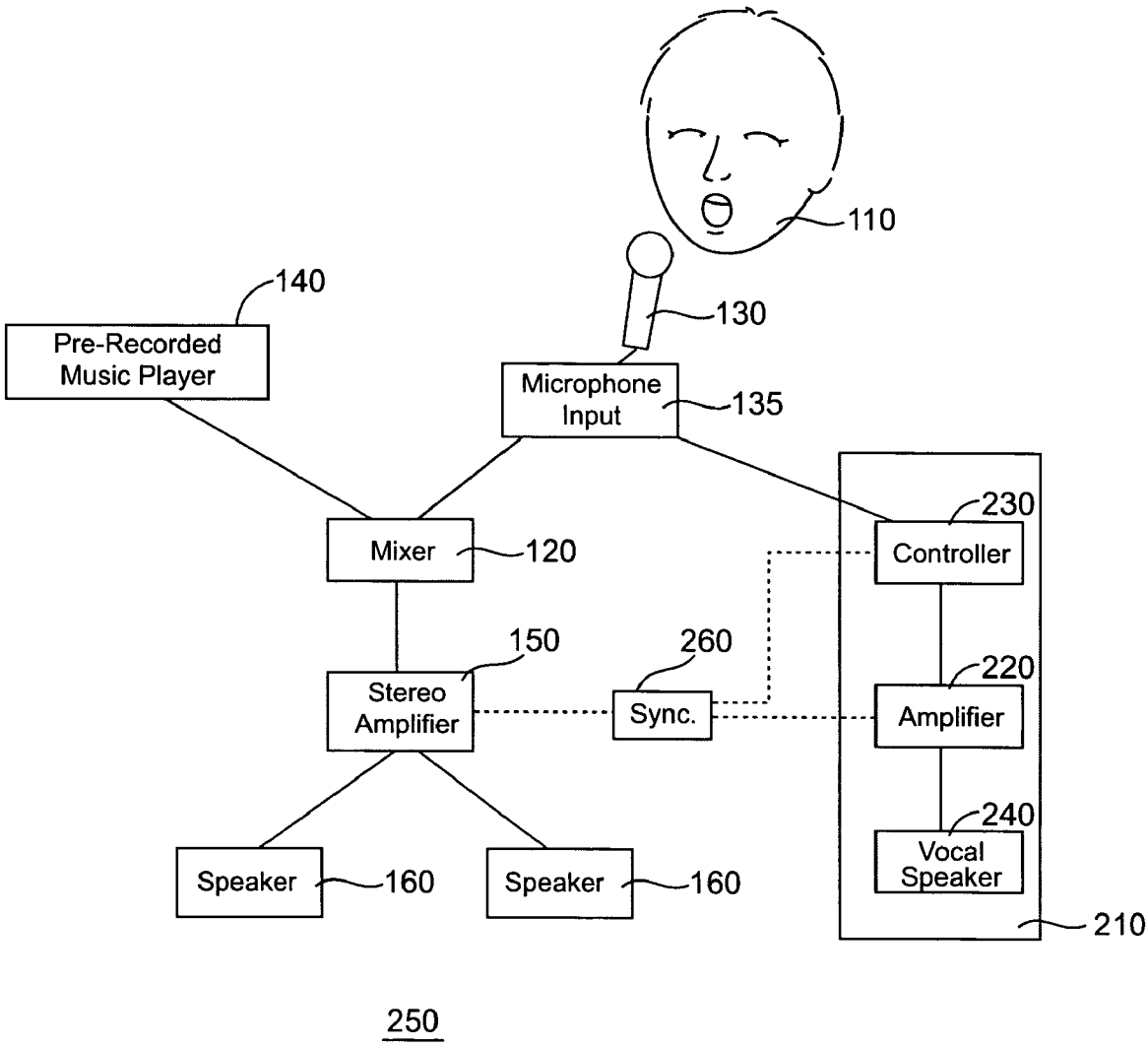
FIG. 2B shows an example functional block diagram of another embodiment of a sound system having a dedicated vocal channel with a synchronization circuit according to the present invention.

FIG. 2B shows an example functional block diagram of another embodiment of a sound system 250 according to the present invention which is a variation of the sound system 200 in FIG. 2A. The sound system 250 in FIG. 2B comprises: (1) a mixer 120 that combines the singer's real-time voice signal from a microphone 130 via an input device 135, with the pre-recorded background song/music signal from a player 140, (2) an amplifier 150 that receives the mixed signal from the mixer 120 to provide amplification or gain boosting, (3) one or more speakers 160 to output the mixed and amplified audio signal, (4) a dedicated channel 210 for the vocal signal from the microphone 130 without using a mixing device, and (5) an optional synchronizer circuit 260 that allows synchronization or feedback, suppression and/or control functions between the amplifier 150 and the dedicated voice channel 210.

For example, the synchronizer circuit 260 may comprise a sensor or feedback signal that provides automatic gain/volume control for the vocal channel 210 depending on the gain/volume of the sound from the pre-mixed speakers 160. In that case, the mixer 120, the amplifier 150 and the speaker 160 form a main channel that is in feedback control configuration with the vocal channel 210 via the circuit 260. As those skilled in the art recognize, the synchronizer circuit 260 may provide other functions as desired.

Further, the present invention can be implemented in various sound systems to improve the vocal signal output in such systems. A few examples of such sound systems are described below, however, those skilled in the art will recognize that the present invention is useful with other sound systems as well.

Figure 3A:
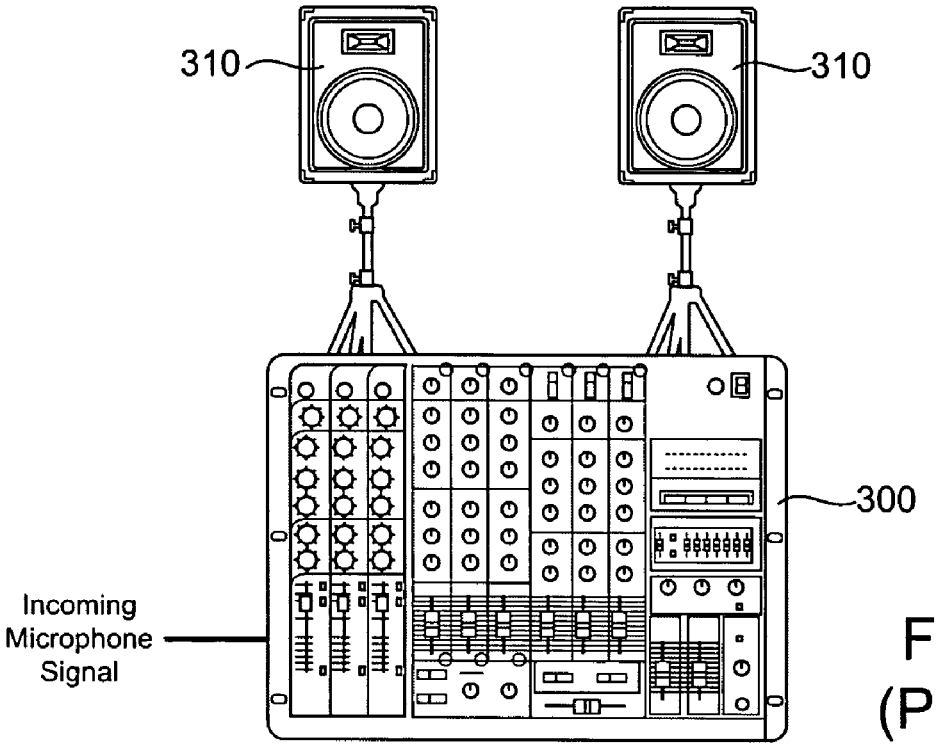
FIG. 3A (Prior Art)
FIG. 3A shows an example diagram of a conventional P.A./karaoke/DJ Setup sound system.

In one example, FIG. 3A shows a conventional public address (P.A)/karaoke/disc jockey (DJ) sound system configuration 300. Such a conventional system 300 provides only mono or stereo output of sound. When microphone output is included for vocals, the microphone voice signal is pre-mixed with music signals in the same mono/stereo configuration, before output from speakers 310.

This pre-mixing of music and microphone signals tends to cause loss of directional sound presence and vocal clarity. In a stereo configuration, each of two speakers 310 outputs pre-mixed music and microphone signal resulting in muddy vocals with lack of direction.

Figure 3B:
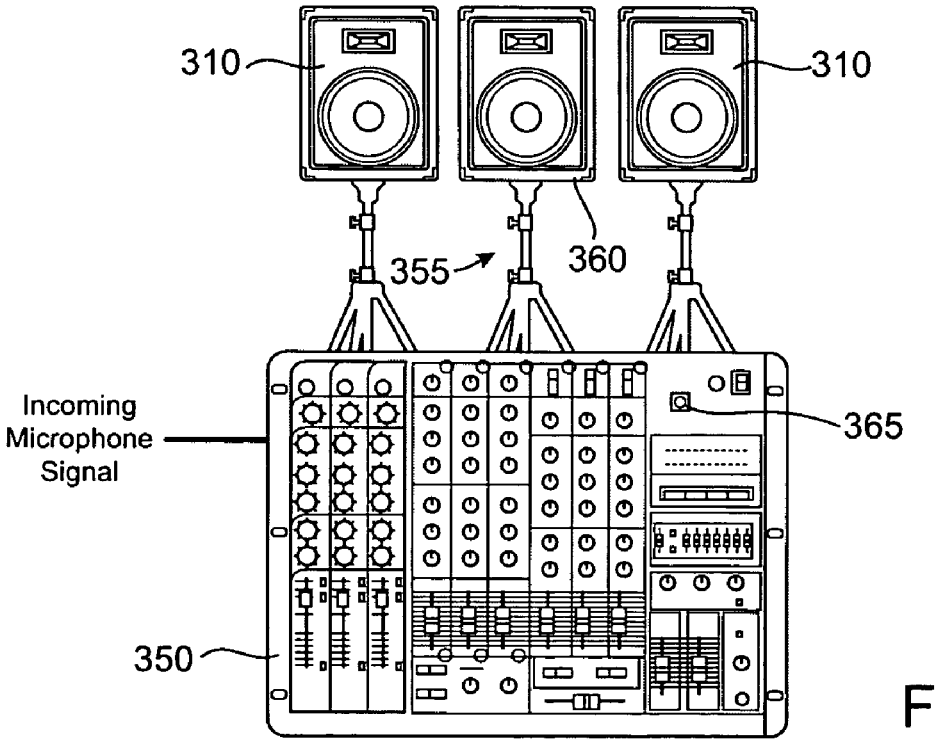
FIG. 3B shows an example diagram of a P.A./karaoke/DJ Setup sound system having a dedicated vocal channel according to an embodiment of the present invention.

FIG. 3B shows an improved P.A./Karaoke/DJ sound system configuration 350, which comprises the conventional system 300 (FIG. 3A) and a dedicated voice channel 355, according to an embodiment of the present invention.

The dedicated voice channel 355 (e.g., channel 210 in FIG. 2A) provides an additional channel dedicated to microphone output to a vocal speaker 360 along with the traditional mono/stereo output of pre-mixed music and microphone output from speaker 310. This allows the microphone output to be heard clearly with directional presence, wherein the vocals do not compete with the music or audio for sound space.

The dedicated vocal channel 355 can be controlled by a user with a channel level control 365 (e.g., volume control, gain control, bass control, treble control, surround sound control, etc. in FIG. 2A), providing superior balancing control and overall improved sound quality.

As such, the left and right speakers 310 output pre-mixed music and microphone signal, and the dedicated vocal speaker 360 outputs clear, vibrant vocals with controllable volume and direction. The channel level control 365 for the vocal speaker 360 allows precise balancing and direction of microphone signal output via the vocal speaker 360.

Figure 4A:
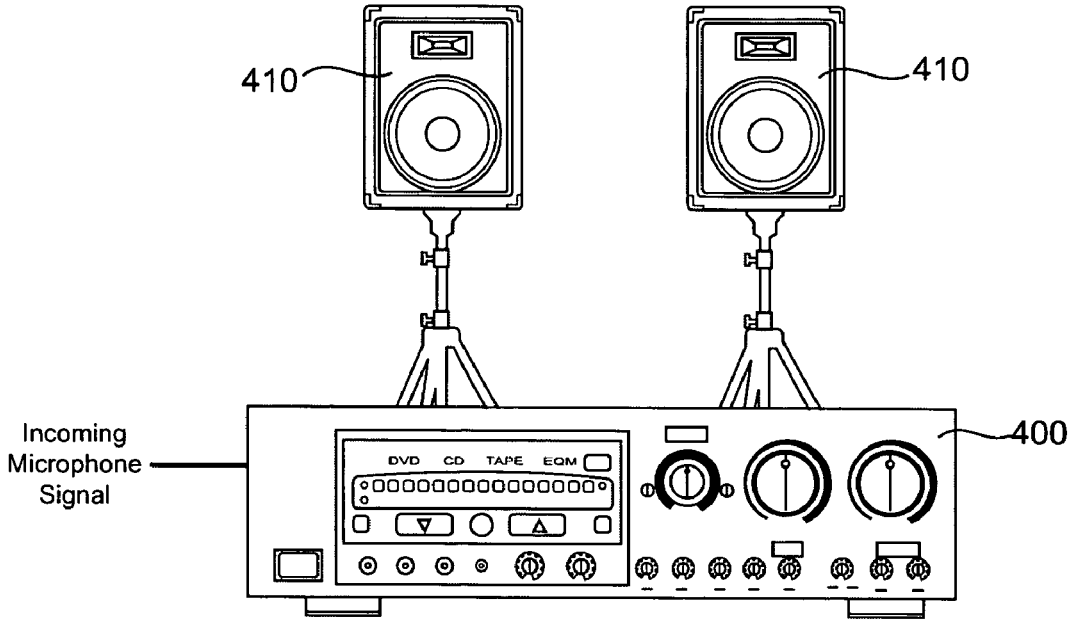
FIG. 4A (Prior Art)
FIG. 4A shows an example diagram of a conventional karaoke mixer or mixing amplifier.

In another example, FIG. 4A shows a conventional karaoke mixer or mixing amplifier 400, which provide mono or stereo sound output from speakers 410. When microphone output is included for vocals, the microphone output signal is pre-mixed with music or audio in the same mono/stereo configuration before output from speakers 410.

Therefore, this pre-mixing of music and microphone signals tends to cause the loss of directional sound presence and vocal clarity. In a stereo configuration, each of two speakers 410 outputs pre-mixed music and microphone signal resulting in muddy vocals with lack of direction.

Figure 4B:
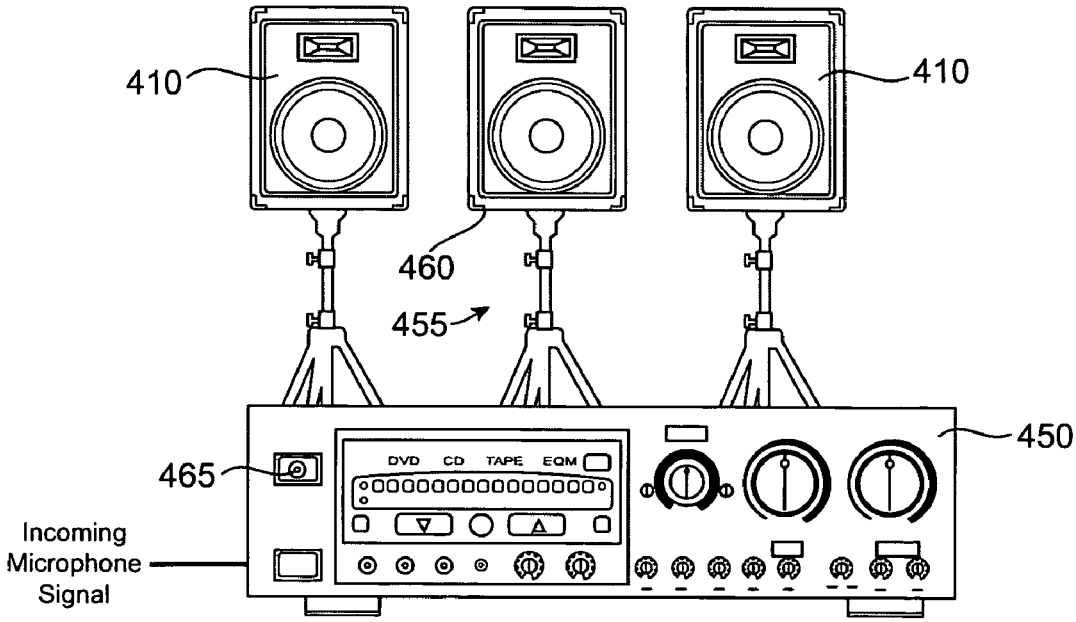
FIG. 4B shows an example diagram of a karaoke mixer or mixing amplifier sound system having a dedicated vocal channel according to an embodiment of the present invention.

FIG. 4B shows an improved Karaoke Mixer or Mixing Amplifier 450, which includes the system 400 of FIG. 4A and a dedicated voice channel 455, according to an embodiment the present invention. The dedicated voice channel 455 (e.g., channel 210, FIG. 2A) provides an additional channel dedicated to microphone output along with the traditional mono/stereo output of pre-mixed music and microphone output. This allows the microphone output to a vocal speaker 460 be heard clearly with directional presence, wherein the vocals do not compete with the music or audio for sound space.

The dedicated vocal channel 455 can be controlled by a user with a channel level control 465, providing superior balancing control and overall improved sound quality. As such, the left and right speakers 410 output pre-mixed music and microphone signal, and the dedicated vocal speaker 460 outputs clear, vibrant vocals with controllable volume and direction. The channel level control 465 for the vocal speaker 460 allows precise balancing and direction of microphone signal output via the vocal speaker 460.

Figure 5A:
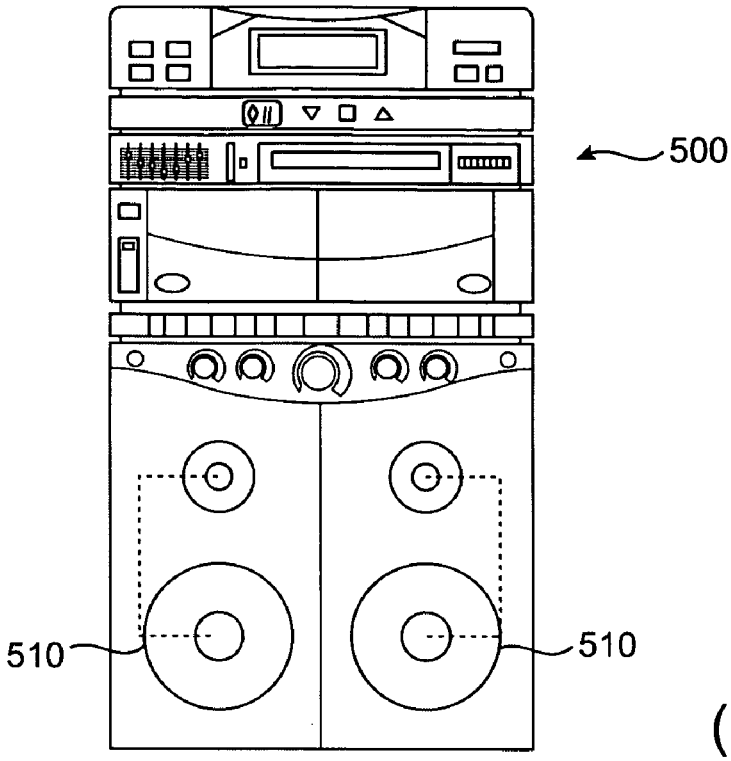
FIG. 5A (Prior Art)
FIG. 5A shows an example diagram of a conventional karaoke system.

Yet in another example, FIG. 5A shows a conventional karaoke system 500, which provides mono or stereo sound output from speakers 510. When microphone output is included for vocals, the microphone output signal is pre-mixed with music or audio in the same mono/stereo configuration before output from speakers 510.

Therefore, this pre-mixing or music and microphone signals tends to cause the loss of directional sound presence and vocal clarity. In a stereo configuration, each of two speakers 510 outputs pre-mixed music and microphone signal resulting in muddy vocals with lack of direction.

Figure 5B:
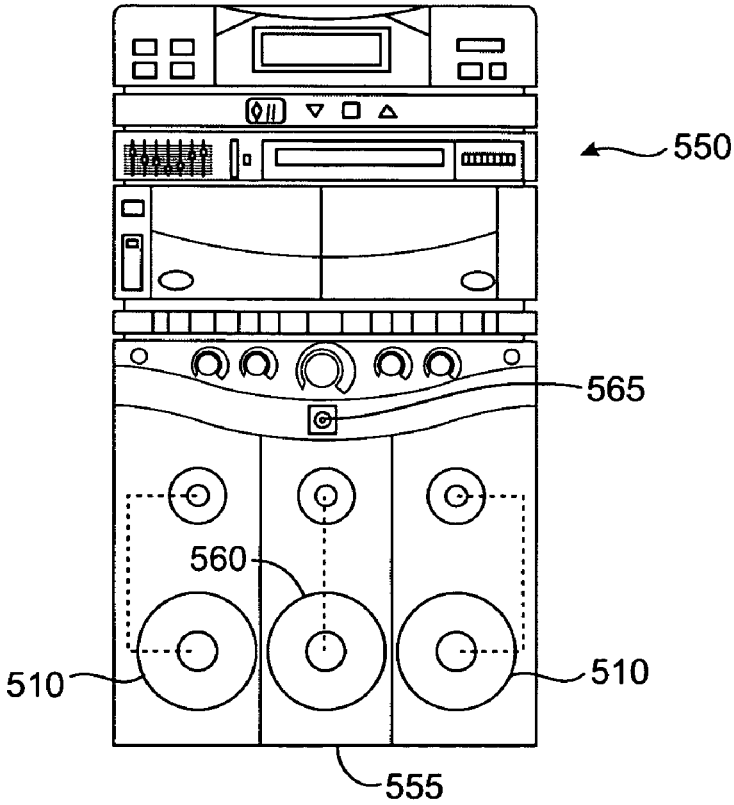
FIG. 5B shows an example diagram of a karaoke sound system having a dedicated vocal channel according to an embodiment of the present invention.

FIG. 5B shows an improved karaoke system 550, which includes the conventional system 500 and a dedicated voice channel 555, according to an embodiment of the present invention. The dedicated voice channel 555 (e.g. channel 210, FIG. 2A) provides an additional channel dedicated to microphone output from a vocal speaker 560 along with the traditional mono/stereo output of pre-mixed music and microphone output from the speakers 510. This allows the microphone output to be heard clearly from the vocal speaker 560 with directional presence, wherein the vocals do not have to compete with the music or audio for sound space.

The dedicated vocal channel 555 can be controlled by a user with a channel level control 565, providing superior balancing control and overall improved sound quality for vocal output from the speaker 560. As such, the left and right speakers 510 output pre-mixed music and microphone signal, and the dedicated vocal speaker 560 outputs clear, vibrant vocals with controllable volume and direction. The channel level control 565 for the vocal speaker allows precise balancing and direction of microphone signal output via the vocal speaker 560.

The present invention can be implemented in other sound systems to improve the vocal signal output in such systems. Those skilled in the art will recognize that the present invention is useful with other sound systems in addition to those described herein by example.

Figure 6:
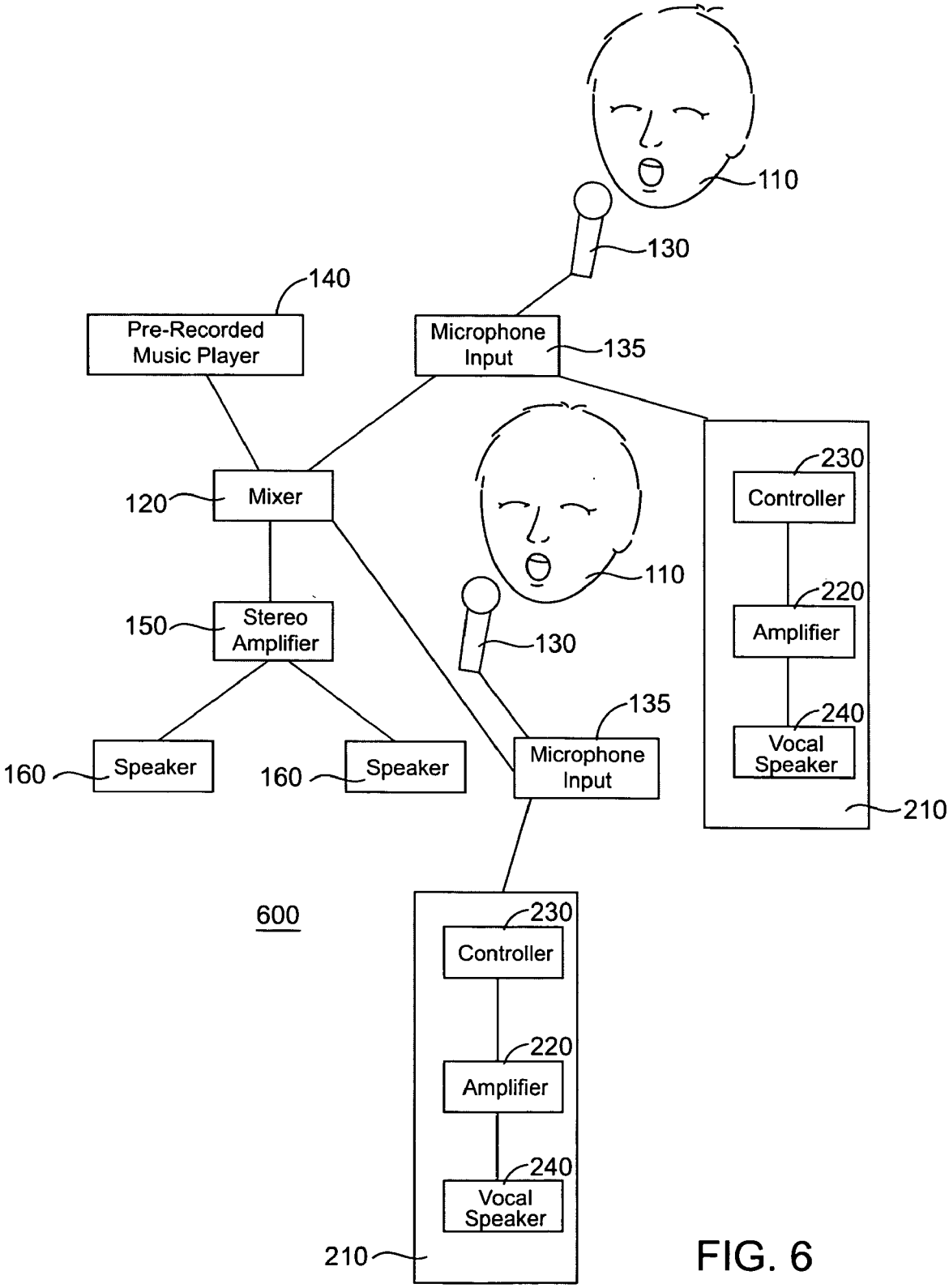
FIG. 6 shows an example block diagram of another example sound system according to the present invention, including two or more dedicated vocal channels.

Further, many alterations and modifications may be made by those skilled in the art without departing from the spirit and scope of the invention. For example, another sound system 600 according to the present invention, shown by the example block diagram in FIG. 6, includes two or more dedicated vocal channels 210, each vocal channel receiving input from a microphone 130 via an input device 135. Further, each dedicated vocal channel 210 can be stereo and include two or more speakers.

Figure 7:
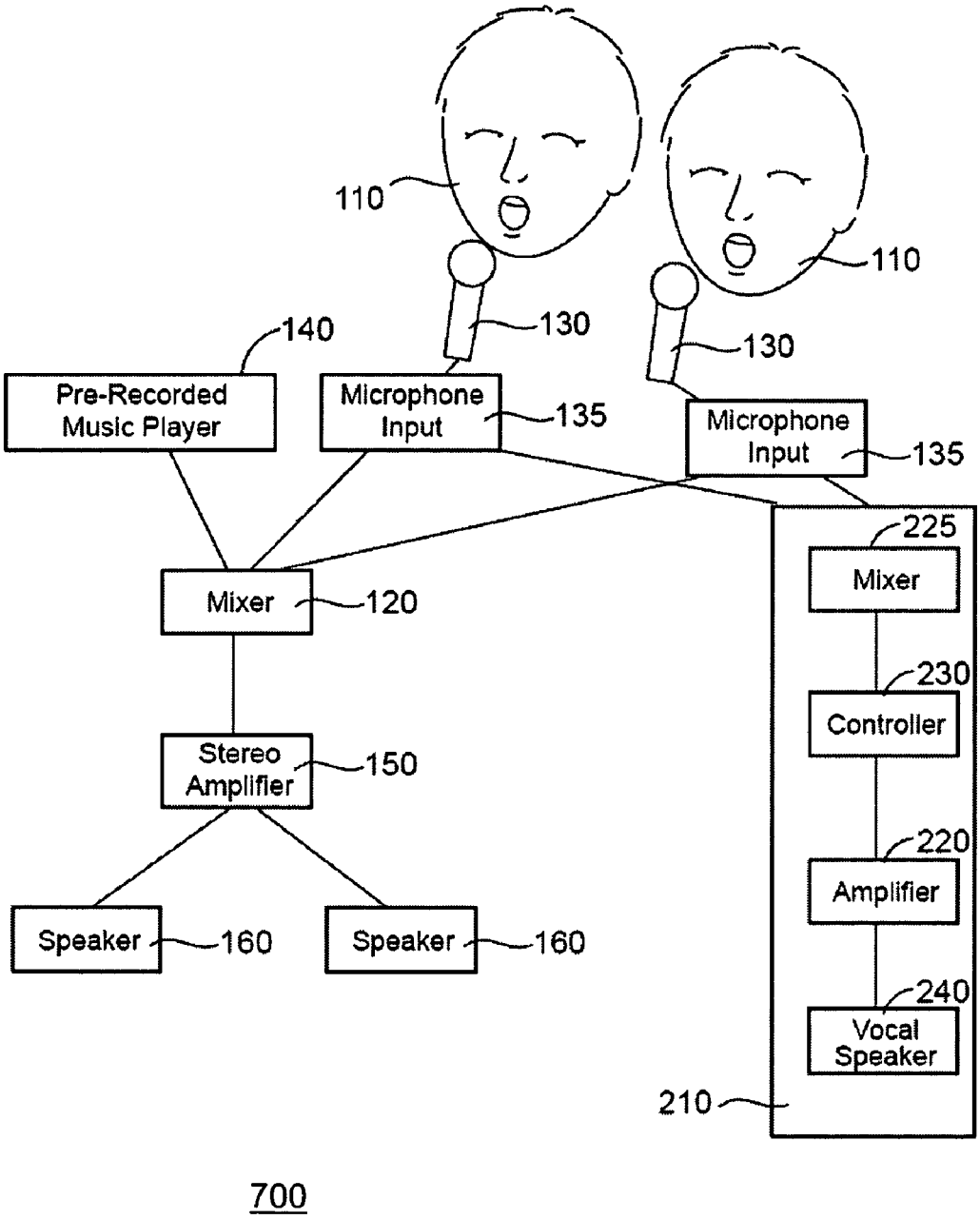
FIG. 7 shows an example block diagram of another example sound system according to the present invention, wherein two microphones provide vocal signals to a dedicated vocal channel.

Yet in another example embodiment according to the present invention, a sound system 700 shown in FIG. 7 includes a vocal channel 210 that can receive vocal signal inputs from two or more microphones 130 via input devices 135. In that case, the vocal channel 210 may include a mixer 225 to mix the input signals. Further, the dedicated vocal channel 210 can be connected to another signal source instead of, or in addition to, the microphone shown in the examples herein.

Therefore, it must be understood that the illustrated embodiment has been set forth only for purposes of example and that it should not be taken as limiting the invention as defined by the following claims. The words used in this specification to describe the invention and its various embodiments are to be understood not only in the sense of their commonly defined meanings, but to include by special definition in this specification structure, material or acts beyond the defined meanings. Thus if an element can be understood in the context of this specification as including more than one meaning, then its use in a claim must be understood as being generic to all possible meanings supported by the specification and by the words itself.

The definitions of the words or elements of the following claims are therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below, or that a single element may be substituted for two or more elements in a claim.

Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

What is claimed is:

1. A sound system for playing a song, comprising:

a generator device that produces an accompaniment sound;

a input device that collects a singing voice which is physically sung along the accompaniment sound;

a main channel comprising a mixer device that mixes the singing voice collected by the input device and the accompaniment sound and generates a mixed output, thereby effecting play of the song; and a vocal channel that receives the singing voice collected by the input device and generate a vocal output, wherein the mixed output and the vocal output are channeled such that the vocal output is output separately from the mixed output, thereby effecting dedicated output of the singing voice with the song.

2. The sound system of claim 1 further comprising:

a first transducer for transduction of the mixed output; and a second transducer for transduction of the vocal output.

3. The sound system of claim 2, wherein:

the first transducer comprises a first loudspeaker; and the second transducer comprises a second loud speaker.

4. The sound system of claim 1, wherein the main channel further comprises a first amplification channel for amplifying the mixed output, and the vocal channel further comprises a second amplification channel for amplifying the vocal output separate from the amplified mixed output.

5. The sound system of claim 1, wherein the vocal channel comprises a first audio signal processor to generate the vocal output with desired characteristics.

6. The sound system of claim 5, wherein the signal processor comprises an amplifier.

7. The sound system of claim 5, wherein the signal processor further includes a control device for user control of the signal processor functions.

8. The sound system of claim 1 further comprising a synchronization circuit that provides one or more of feedback, suppression and control between the vocal channel and the main channel.

9. The sound system of claim 1, wherein the main channel and the vocal channel are separate channels to transducing nodes.

10. The sound system of claim 1, wherein the main channel and the vocal channel are separate channels wherein the mixed output and the vocal output are channeled such that the vocal output is transduced separately from the mixed output.

11. A karaoke apparatus for playing a karaoke song, comprising:

a generator device that produces an orchestral accompaniment sound signal;

a first input device that collects a singing voice which is physically sung along the orchestral accompaniment sound and generates a vocal signal;

a mixer device that mixes the vocal signal from the input device and the orchestral accompaniment sound signal from the generator device, to generate a mixed output signal, thereby effecting play of the karaoke song; and a vocal channel that receives the vocal signal from the input device and generate a vocal output signal, wherein the mixed output and the vocal output are channeled such that the vocal output is output separately from the mixed output, thereby effecting dedicated output of the singing voice with the karaoke song.

12. The karaoke apparatus of claim 11 further comprising:

a first transducer for transduction of the mixed output signal; and a second transducer for transduction of the vocal output signal.

13. The karaoke apparatus of claim 12, wherein:

the first transducer comprises a first loudspeaker; and the second transducer comprises a second loud speaker.

14. The karaoke apparatus of claim 11, wherein the input device comprises a microphone.

15. The karaoke apparatus of claim 11, further comprising an amplifier for amplifying the mixed output signal, and the vocal channel further comprises a separate amplifier for amplifying the vocal output separate from the amplified mixed output.

16. The karaoke apparatus of claim 15, wherein the amplifier is a stereo amplifier.

17. The karaoke apparatus of claim 11, wherein the vocal channel comprises a first audio signal processor for processing the vocal signal to generate the vocal output signal with desired characteristics.

18. The karaoke apparatus of claim 17, wherein the signal processor comprises an amplifier for amplifying the vocal signal to generate the vocal output signal.

19. The karaoke apparatus of claim 18, wherein the amplifier further includes a gain controller for controlling the amplification of the vocal signal.

20. The karaoke apparatus of claim 11 further comprising a second input device that collects another singing voice and generates a second vocal signal, wherein the second vocal signal is provided to the vocal channel.

21. A karaoke method of playing a karaoke song, comprising:

providing an orchestral accompaniment sound;

collecting a singing voice which is physically sung along the orchestral accompaniment sound;

mixing the collected singing voice and the orchestral accompaniment sound, and generating a mixed output, thereby effecting play of the karaoke song; and generating a vocal output from the collected singing voice, wherein the mixed output and the vocal output are channeled such that the vocal output is output separately from the mixed output, thereby effecting dedicated play of the singing voice with the karaoke song.

22. The method of claim 21 further comprising the steps of:

providing a first transducer for transduction of the mixed output; and providing a second transducer for transduction of the vocal output.

23. The method of claim 22, wherein:

the first transducer comprises a first loudspeaker; and the second transducer comprises a second loud speaker.

24. The method of claim 21, wherein collecting the signing voice comprises the steps of collecting the signing voice using a microphone.

25. The method of claim 21, further comprising the steps of:

amplifying the mixed output; and amplifying the vocal output separate from the amplified mixed output.

26. The method of claim 21, wherein the step of generating the vocal output further comprises the step of processing the vocal signal to provide desired audio characteristics in the vocal output.

27. The method of claim 26, wherein the step of processing the vocal output includes the steps of amplifying the vocal output.

28. The method of claim 27, wherein the step of amplifying the vocal output further comprises the steps of controlling the level of amplification of the vocal output.

* * * * *